United States Patent [19]

Ichinose

[11] 4,094,242

[45] June 13, 1978

[54] LIFTING DEVICES FOR FLAT SCREEN PRINTER

[76] Inventor: Shiro Ichinose, 11-8,4-Chome, Shinohara Kita-machi, Nada-ku; Kobe-shi, Hyogo-ken, Japan

[21] Appl. No.: 695,392

[22] Filed: Jun. 14, 1976

[51] Int. Cl.[2] ..... B41F 15/08; B41F 15/44

[52] U.S. Cl. ..... 101/123; 101/124; 101/126

[58] Field of Search ..... 101/115, 116, 123, 124, 101/126, 129

[56] References Cited

U.S. PATENT DOCUMENTS

| | | | |
|---|---|---|---|
| 1,922,710 | 8/1933 | Owens | 101/123 |
| 2,624,276 | 1/1953 | Klopfenstein | 101/123 |
| 2,662,470 | 12/1953 | Fordyce | 101/123 |
| 2,845,859 | 8/1958 | Gattuso | 101/126 |
| 3,291,044 | 12/1966 | Van der Winden | 101/118 |

FOREIGN PATENT DOCUMENTS

| | | | |
|---|---|---|---|
| 559,629 | 3/1975 | Switzerland | 101/115 |

*Primary Examiner*—Ronald E. Suter
*Attorney, Agent, or Firm*—Sherman & Shalloway

[57] ABSTRACT

A screen printing machine comprising a transporting mechanism supporting thereon a material to be printed for transporting the material continuously or intermittently to a printing operation zone is disclosed in which a lifting device is used to bring the material to be printed into contact with a screen and a squeegee member. The printing machine includes a screen disposed in the printing operation zone above a running passage for the material to be printed and a squeegee member disposed to squeeze out a printing paste or ink through the screen onto the material to be printed. The lifting device causes the material to be printed to be lifted and brings it into contact with the screen during the printing step and lowers and separates the material from the screen during the non-printing period by moving the transporting mechanism supporting the material to be printed vertically downward and away from the screen and/or moving the screen and squeegee vertically upward and away from the transporting mechanism supporting the material to be printed. The lifting device includes a partially toothed driving wheel, a partially toothed lifting wheel, and a lifting cam integral with the partially toothed lifting wheel. The partially toothed driving wheel and the partially toothed lifting wheel are engaged with each other inermittently and synchronously so that by the engagement between the two partially toothed wheels the lifting member is caused to move vertically upward or downward and by release of the engagement between the two partially toothed wheels the lifting member is restrained at the elevated or lowered position.

4 Claims, 5 Drawing Figures

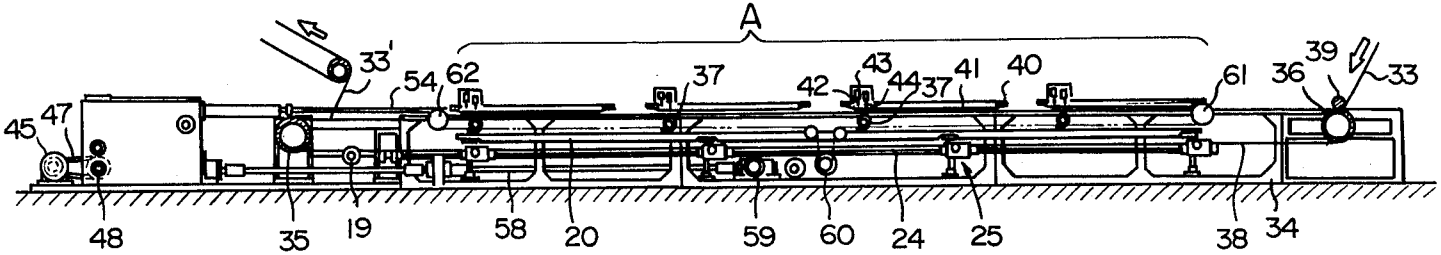
Fig. 4-A
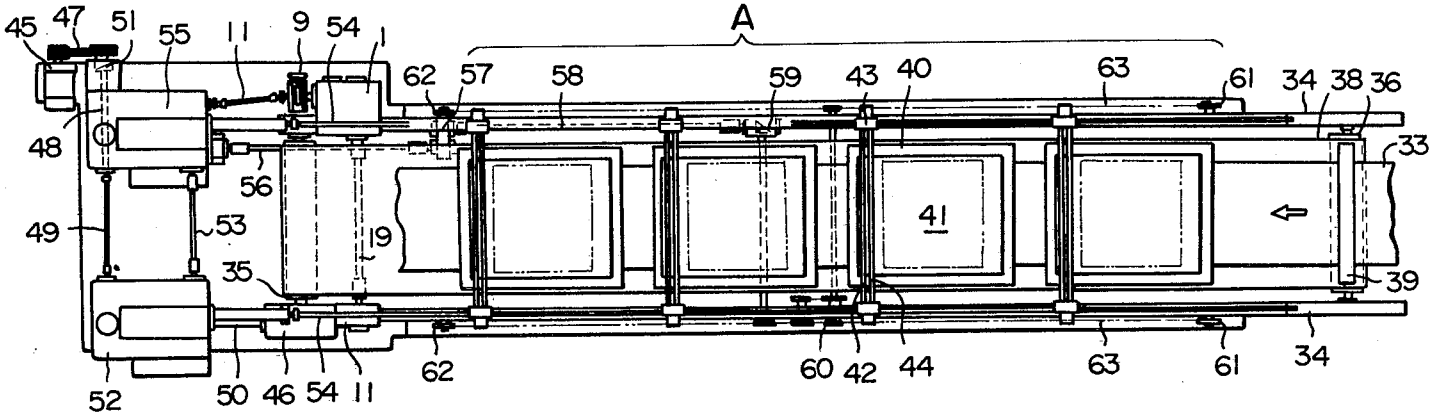
Fig. 4-B

LIFTING DEVICES FOR FLAT SCREEN PRINTER

This invention relates to a lifting device in a screen printing machine. More particularly, in a screen printing machine of the type where a transportation mechanism in the printing zone and a squeegee member and/or a screen are relatively moved in the vertical direction so that during the printing operation a material to be printed is caused to come into contact with the screen and during the period where the printing operation is not performed (hereinafter referred to as "non-printing period") the material to be printed is separated from the screen, the present invention relates to a lifting device in which relative vertical movements of the respective members and operations of stopping these members at elevated or lowered positions can be performed precisely according to a mechanically controlled program.

In conventional automatic screen printing machines using flat screens or the like, an endless belt for supporting and transporting a material to be printed, such as cloth, is fed intermittently or continuously in a printing zone, a screen is contacted with the material to be printed, and then, a squeegee member is scanned on the screen to squeeze out a printing paste on the material to be printed.

In conventional automatic printing machines of the type where an endless belt for supporting and transporting a material to be printed is fed intermittently in a printing zone, while the endless belt is stopped, a screen and squeegee member usually supported on a vertically movable printing frame are brought down on the material to be printed, to perform the above printing operation, and the screen and squeegee member are lifted up and the endless belt is fed again.

In conventional printing machines of the type where an endless belt is continuously fed, the printing is performed by feeding a material to be printed into a printing operation zone, transporting in the supported state the material to be printed continuously at a constant speed in the lengthwise direction, moving a flat screen having a certain length in the longitudinal direction thereof along the material to be printed at the same speed in the same direction as the material to be printed to cause the material to be printed, which is being transported on a supporting and transporting member, to fall in contact with the flat screen, scanning a squeegee member disposed above said flat screen from one end of the flat screen to the other end to thereby print said material, releasing the contact between the flat screen and the supporting and transporting member just before the squeegee member arrives at the other end of the flat screen, moving the squeegee member and the flat screen in a direction reverse to the moving direction for the printing operation to return said squeegee member and said flat screen to the original printing-starting positions, and repeating the foregoing operations.

As will be apparent from the foregoing illustration, in printing machines using screens, especially flat screens, it is necessary to move relatively a transporting mechanism in the printing zone and a squeegee member and/or a screen in the vertical direction so that a material to be printed is caused to fall in contact with the screen during the printing operation and the material is separated from the screen during the non-printing operation.

These vertical movement operations are also necessary in ordinary screen printing methods, powder screen print molding methods and the like methods.

It is very difficult to perform operations of lifting the above-mentioned members, stopping them at elevated positions, lowering these members and stopping them at lowered positions according to a program in which the times and displacements are strictly set.

As a driving device for performing vertical movements in these automatic screen printing machines, there have heretofore been used hydraulic cylinder devices and the like. Further, various limit switches or photoelectric switches are used for setting of positions. According to such fluid-driving or electric control system, however, because of deviations or delays in vertical movements of the respective members or timings for stopping or starting these movements, it is very difficult to perform operations for vertical movements according to a strictly set or controlled program. Further, it is very difficult to make timings of these operations quite in accord with timings of other operations in the printing machine.

Vertical movement operations have heretofore been performed by rotating cams alone continuously. In this case, however, since the cams are not stopped at all, sizes of the cams should inevitably be increased, and since the working angles of the cams are inevitably large, no smooth operation can be obtained.

In order to avoid the foregoing disadvantages, in conventional automatic flat screen printing machines of the type where an endless belt is fed intermittently, a driving system for intermittent feeding of the endless belt and a driving system for vertical movements are disposed independently, and a sufficiently long time is provided for stopping of the endless belt supporting and transporting a material to be printed and during this long time the vertical movement of the printing frame is accomplished. Therefore, the operation efficiency of the printing machine is low and it is impossible to enhance the manufacturing rate.

In conventional automatic screen printing machines of the type where an endless belt is continuously fed, in order to avoid the above-mentioned disadvantages, it is necessary to conduct the operations of contacting a stencil with a material to be printed at the start of the printing step and separating the stencil from the material after the printing step so that the positions of the stencil and the material being transported continuously are made exactly in accord with each other for every repeat of a pattern to be printed, and timings of these operations should be exactly controlled so as to obtain a good matching between the stencil and the material for every repeat of the pattern. Accordingly, the automatic screen printing machine of the latter type has not been practically employed on an industrial scale.

It is therefore a primary object of the present invention to provide a lifting device of an automatic screen printing machine which can perform operations of lifting up vertically moving members of the printing machine, stopping them at elevated positions, lowering them and stopping them at lowered positions precisely and assuredly according to a mechanically controlled program.

Another object of the present invention is to provide a lifting device of an automatic printing machine which can perform the above operations according to precisely set programs of timings and displacements while providing sufficiently long times for stopping of vertically moving members of the printing machine at the elevated or lowered positions.

Still another object of the present invention is to provide a lifting device of an automatic screen printing machine which generates no substantial mechanical shocks at the start or termination of vertical movements of vertically moving members of the printing machine and makes it possible to perform the printing operation very smoothly.

A further object of the present invention is to provide a lifting device which is used for an automatic flat screen printing machine in which the printing operation is performed while a material to be printed is being fed continuously and which makes it possible to perform respective operations in the printing machine at good timings.

In accordance with this invention, there is provided a lifting device in a screen printing machine which screen printing machine comprises a transporting mechanism for supporting thereon a material to be printed and transporting it continuously or intermittently to a printing operation zone, a flat screen disposed above a running passage for the material to be printed in the printing operation zone, a squeegee member disposed to squeeze out a printing paste or ink onto the material to be printed through said screen, and a lifting device for causing the material to be printed to come into contact with the screen at the printing step and subsequently separating the material from the screen during the non-printing period by vertically moving at least one of the transporting mechanism and the squeegee member and screen relative to each other; the lifting device including a partially toothed driving wheel, a partially toothed lifting wheel and a lifting cam pivoted on said partially toothed lifting wheel, said partially toothed driving wheel and said partially toothed lifting wheel being engaged with each other intermittently and synchronously so that by this engagement between the two partially toothed wheels said lifting member is caused to make a vertical movement and by release of said engagement said lifting member is restrained at the elevated or lowered position.

This invention will now be described in detail by reference to the accompanying drawings, in which.

FIG. 4-A is a side view illustrating the arrangement of an automatic screen printing machine to which the lifting device of the present invention is applied; and FIG. 4-B is a plan view showing the arrangement of the automatic screen printing machine illustrated in FIG. 4-A.

Figure 1:
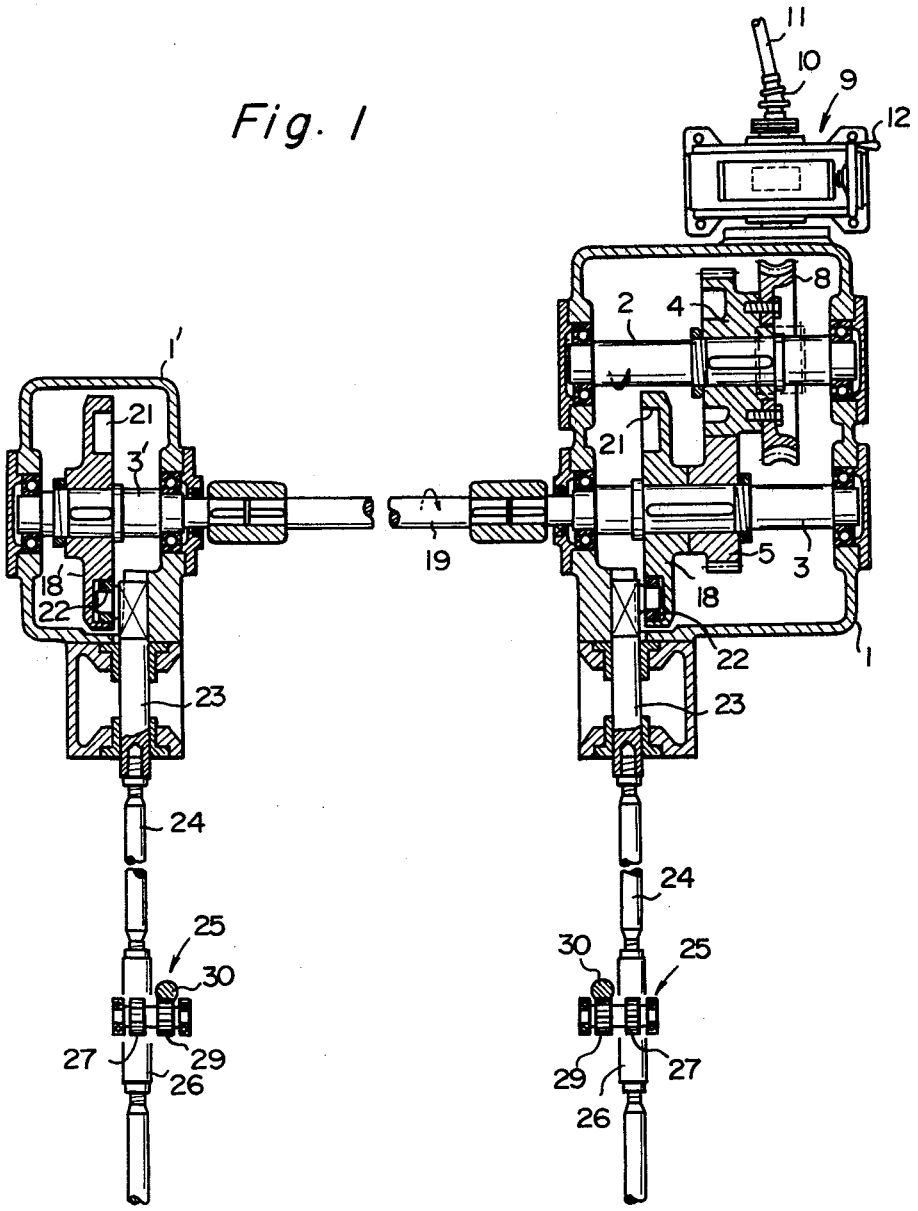
FIG. 1 is a sectional view showing one embodiment of the lifting device of the present invention.
Figure 2:
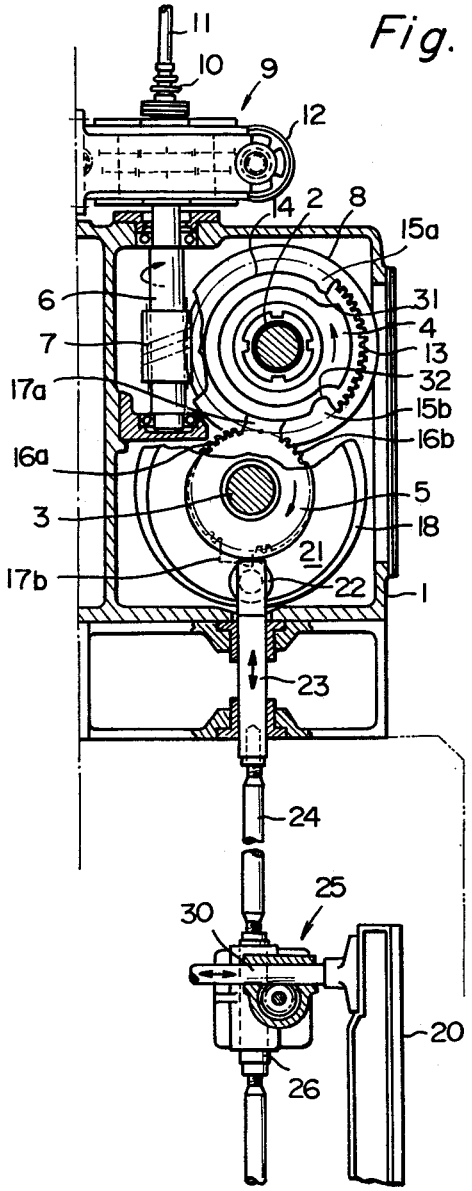
FIG. 2 is a sectional side view illustrating the lifting device shown in FIG. 1.

Referring to FIGS. 1 and 2 showing the lifting device of the present invention which is especially suitably used for an automatic flat screen printing machine of the type where a material to be printed is continuously fed, a continuous rotation shaft 2 and an intermittent rotation shaft 3 are rotatably mounted on a machine frame 1 through bearings in parallel to each other and suitably spacedly from each other. A partially toothed driving wheel 4 is fixed to the continuous rotation shaft 2 and a partially toothed lifting wheel 5 is fixed to the intermittent rotation shaft 3, and these partially toothed wheels 4 and 5 are disposed in such a relationship that they are intermittently engaged with each other.

The output of a driving motor or reduction gear (not shown) can be transmitted to this continuous rotation shaft 2 directly or through other mechanism such as a timing adjusting device or the like.

In the embodiment shown in FIGS. 1 and 2, an input shaft 6 extending in a direction perpendicular to the continuous rotation shaft 2 is rotatably mounted through a bearing, and a worm 7 is fixed to the input shaft 6 and is engaged with a worm gear 8 fixed to the continuous rotation shaft 2. A lifting timing adjusting device indicated as a whole by reference numeral 9 is mounted on the machine frame 1, and the output side of the device 9 is connected to the input shaft 6 and the input side of the device 9 is connected to a driving connecting shaft 11 through a universal joint 10. The lifting timing adjusting device 9 consists of a differential gear device, and the timing can be quickened or retarded by turning an adjusting handle 12.

The partially toothed driving wheel 4 comprises a toothed large-diameter portion 13, a non-toothed smooth small-diameter portion 14 and stepped shoulders 15*a* and 15*b* formed in two boundary portions between the portions 13 and 14.

The partially toothed lifting wheel 5 comprises small-diameter portions 16*a* and 16*b* having teeth to be engaged with the teeth of the partially toothed driving wheel 4 and tail portions 17*a* and 17*b* extending in the radial direction outwardly over the small-diameter portions 16*a* and 16*b*. The top ends of the tail portions 17*a* and 17*b* are formed into cancave faces to be engaged with the circumferential face of the small-diameter portion 14 of the driving wheel 4. The number of teeth on the large-diameter portion 13 of the driving wheel 4 is equal to the number of teeth on the small-diameter portions 16*a* and 16*b* of the lifting wheel 5.

A lifting cam 18 is fixed to the shaft 3 to which the partially toothed lifting wheel 5 is fixed. Preferably, a lifting cam case 1′ is disposed on the side opposite to the side where the lifting device case 1 is disposed and a lifting cam 18′ fixed to a shaft 3′ is rotatably contained in this lifting cam device case 1′. The shaft 3 is connected to the shaft 3′ through a connecting rod 19, and a pair of confronting lifting cam plates 18 and 18′ are plane-symmetrical with each other and rotated in the same phase.

A cam groove 21 is formed on the lifting cam plate 18 (18′) to set the elevated and lowered positions of a lifting member 20 (see FIG. 2) and controlling the operation pattern at lifting and lowering. A cam roller 22 is engaged with the cam groove 21, and this cam roller 22 is fixed to one end of a lifting output shaft 23 extending in a direction perpendicular to the intermittent rotation shaft 3.

This lifting output shaft 23 is mounted on the machine frame 1 so that it can slide in the axial direction, and the driving power of this output shaft 23 is transmitted to the lifting member 20 directly or through other suitable driving power transmission mechanism. In the embodiment shown in FIGS. 1 and 2, a connecting rod 24 is fixed to the output shaft 23 and this rod 24 extends so that it passes through a plurality of pinion-rack mechanisms 25 and the rod 24 has racks 26 in respective mechanisms 25 which are engaged with pinions 27. Other pinion 29 is pivoted on each pinion 27, and a rack 30 extending in the vertical direction from the lifting member 20 is engaged with the latter pinion 29. In this arrangement, when the lifting connecting rod 24 is slided in the lengthwise direction of the machine, the lifting member 20 is moved in the vertical direction through the pinion-rack mechanisms 25.

The rotation of the lifting input shaft 11 is transmitted to the partially toothed driving wheel 4 through the output shaft 6 of the differential gear device 9, the worm 7 and the worm gear 8, and the wheel 4 is rotated continuously in one direction (in the counter-clockwise direction in the drawings).

Figure 3:
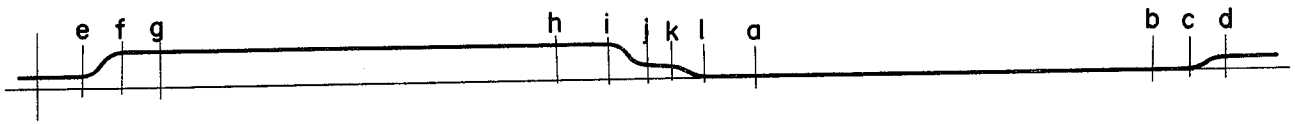
FIG. 3 is a diagram illustrating the displacement of the lifting member by reference to the operation of the cam.

Operations for vertical movements by the partially toothed wheels 4 and 5 and the cam 18 will be apparent from the following illustration made by reference to FIGS. 1 and 2 and from FIG. 3 illustrating these operations.

In FIG. 2 illustrating the state where the lifting member 20 of the printing machine is stopped at the lowered position (the lowermost position indicated by line *a–b* in FIG. 3), namely the non-printing state, the tail 17*a* of the partially toothed lifting wheel 5 is engaged with the circumference of the small-diameter portion 14 of the partially toothed driving wheel 4 and kept restrained, and therefore, the lifting cam 18 is stopped in the restrained state, while the cam roller 22 is engaged with the lowermost position-setting part of the cam groove 21.

When the partially toothed driving wheel 4 is further rotated in the counter-clockwise direction, the stepped shoulder 15*a* of the wheel 4 comes into engagement with the tail portion 17*a* of the partially toothed lifting wheel 5. Since a notch 31 allowing the rotation of the tail portion 17*a* is formed on the stepped shoulder 15*a*, the restrainment by the tail portion 17*a* is released and the tail portion 17*a* is pressed by the stepped shoulder 15*a*, whereby the teeth 13 are engaged with the teeth 16*a* and the partially toothed lifting wheel 5 is driven and rotated in the clockwise direction. With this rotation of the wheel 5, also the lifting cam 18 is rotated in the clockwise direction to move the cam roller 22 and in turn the output shaft 23 upwardly in the drawings. Thus, the lifting member 20 is lifted up from the lowermost position through the medium position to the uppermost position according to an operation pattern indicated by curve *b-c-d-e-f-g* in FIG. 3.

The shape of the cam groove 21 formed on the lifting cam groove 18 is not particularly critical, and an optional shape can be chosen according to a desirable pattern of the vertical movement. However, in order to prevent generation of shocks at the start or termination of the vertical movement of the lifting member 20 in the automatic screen printing machine and perform the operation of exchange between squeegees or exchange of the squeege with the doctor blade smoothly by this vertical movement of the lifting member 20, it is preferred that the shape of the cam groove be such that displacements of the output shaft 23 and lifting member 20 as shown in FIG. 3 are caused. More specifically, with the clockwise direction rotation of the partially toothed lifting wheel 5, the lifting cam 18 is rotated in the clockwise direction. However, while the angle of this rotation is within a certain range, the lifting member 20 is still in the stopped state and no displacement is caused (line *b–c* in FIG. 3). When the lifting cam 18 is further rotated, the lifting member 20 is gradually accelerated and elevated, and then, the speed of the lifting member 20 is gradually reduced and stopped at the medium position (curve *c–d* in FIG. 3). Although the lifting cam 18 still continues rotation, the lifting member 20 is kept in the stopped state at the medium position (line *d–e* in FIG. 3). When the lifting cam 18 is further rotated, the lifting member 20 is gradually accelerated and elevated from the medium position, and the speed of the lifting member 20 is then gradually reduced and it is stopped at the uppermost elevated position (curve *e–f* in FIG. 3). Although the lifting cam 18 still continues rotation, the lifting member 20 is kept in the stopped state at the elevated position, and then, the rotation of the lifting cam 18 is stopped (line *f–g* in FIG. 3).

If the shape of the cam groove 21 of the lifting cam 18 is so arranged that the above-mentioned displacements are caused in the output shaft or the lifting member 20, mechanical shocks caused by the vertical movement and stoppage thereof can be moderated and absorbed, and therefore, the operation can be performed very smoothly and it is possible to exchange one squeegee with another squeegee or exchange the squeegee with the doctor blade very smoothly.

After the partially toothed lifting wheel 5 and in turn the lifting cam 18 make a ½ rotation in the clockwise direction, the other tail portion 17*b* is engaged with the circumference of the small-diameter portion 14 through the notch 32 of the stepped shoulder 15*b* of the driving wheel 4, whereby the lifting wheel 5 and cam 18 are stopped and restrained, and the lifting member 20 is stopped at the uppermost position (line *g–h* in FIG. 3).

When the partially toothed driving wheel 4 is rotated in the counter-clockwise direction and the stepped shoulder 15*a* falls in engagement with the tail portion 17*b* of the partially toothed lifting wheel 5, in the same manner as described above with respect to the tail portion 17*a*, the lifting wheel 5 and lifting cam 18 are released from the restrainment and rotated in the clockwise direction by the engagement between teeth 13 and 16*b*, whereby the cam roller 22 and the output shaft 23 are moved downwardly in the drawings and the lifting member 20 is lowered from the uppermost position through the medium position to the lowermost position according to an operation pattern indicated by curve *h-i-j-k-l-a* in FIG. 3. The pattern of this lowering movement is quite reverse to the above-mentioned pattern of the lifting movement. Therefore, explanation of this pattern of the lowering movement is omitted.

Then, the tail portion 16*a* of the partially toothed lifting wheel 5 is engaged with the circumference of the small-diameter portion 14 through the notch 32 of the stepped shoulder 15*b*, whereby the lifting wheel 5 and lifting cam 18 are restrained and the lifting member 20 is stopped at the lowermost position (line *a–b* in FIG. 3).

When partially toothed wheels which are intermittently driven and restrained are used in combination with lifting cams in a manner as described above as the lifting device in the flat screen printing apparatus according to the present invention, there are attained various advantages.

For example, as is seen from FIG. 3, the time for stopping at the elevated or lowered position can be made sufficiently longer as compared with the time for lifting or lowering, and operations of the lifting member, such as lifting, stopping at the elevated position, lowering and stopping at the lowered position, can be performed at good timings without deviation according to the strictly controlled program.

Various cam devices are known as means for vertically moving various members precisely according to a mechanically controlled program. However, in conventional cam devices, it is generally difficult to provide a sufficiently long time for stopping at the elevated or lowered position as compared with the time provided for the vertical movement, and therefore, any of these known cam devices cannot be effectively used as a lifting device in a screen printing machine. In contrast, in the present invention, both the time for the vertical movement and the time for restrainment at the elevated position or lowered position can optionally be adjusted by adjusting appropriately the ratio of the toothed large-diameter portion 13 to the non-toothed smooth small-diameter portion 14 in the partially toothed wheel 4 for driving the partially toothed lifting wheel 5.

In the embodiment shown in FIGS. 1 and 2, two tail portions 17*a* and 17*b* are formed on the partially toothed lifting wheel 5. In the present invention, it is possible to form one tail portion on the partially toothed lifting wheel 5 to set a more delicate pattern of the vertical movement, or to increase the number of tail portions formed on the wheel 5 to set a pattern of the vertical movement more simply. Further, although the rotation of the partially toothed lifting wheel 5 is stopped by the tail portion in the embodiment shown in FIGS. 1 and 2 when the engagement between the partially toothed wheels 4 and 5 is released, it is possible to stop the rotation of the partially toothed lifting wheel 5 by a known restraining mechanism such as (1) an electromagnetic brake or mechanical mechanism, (2) a locking mechanism including a pin and a hole or groove, or (3) other suitable wheel mechanism.

The lifting device of the present invention can be used as lifting means for screens, squeegees, printing frames and transporting means in the printing zone in various automatic screen printing machines.

In the instant specification, the word "printing" is used to mean not only ordinary printing of papers, films and the like but also dye printing of fabrics, cloths and the like.

Referring now to FIGS. 4-A and 4-B illustrating an embodiment where the lifting device of the present invention is applied to an automatic flat screen printing machine of the type where a material to be printed is continuously fed, a mechanism for supporting and transporting a material 33 to be printed comprises a driving roller 35 and a driven roller 36 disposed on a machine frame 34 on both the sides of a plurality of printing zones A, receiving rollers 37 disposed for respective printing zones, and an endless belt 38 supported and continuously driven by said driving, driven and receiving rollers 35, 36 and 37. A paste is applied to this endless belt 38 by a suitable pasting mechanism (not shown), and the continuous material 33 to be printed is applied to the supporting surface of the endless belt 38 by a pasting roller 39 and fed to the printing zones A continuously at a constant speed. The printed material 33' is peeled from the endless belt 38 and fed to a winding reel or post treatment step (not shown).

The printing machine including the lifting device of the present invention can be applied to printing of ordinary fabrics and cloths and screen printing of papers, films, metal foils and metal sheets. When a highly flexible material such as a fabric or cloth is printed, a supporting and transporting member such as an endless belt is used and the printing operation is conducted while the material to be printed is applied or pasted to this supporting and transporting member, or a continuous paper sheet is used as the supporting and transporting member instead of the endless belt, the fabric or cloth is pasted to the continuous paper sheet and the printing operation is conducted while the assembly of the paper sheet and the fabric or cloth is being continuously fed. When a material having a relatively low flexibility, such as a paper, a film, a metal foil, a laminate thereof or a metal sheet, is printed, if a suitable tension adjusting mechanism is disposed on the side of a feed reel or winding reel of the material, provision of a supporting and transporting member such as an endless belt can be omitted.

In the printing zones A, flat screens 41 are supported on screen frames 40 above the running passage for the material 33 to be printed, namely above the upper portion of the endless belt 38, and the number of the screens 41 corresponds to the number of colors of a pattern to be printed. Each of the screen frames 40 is supported on a guide rail disposed along the endless belt 38 so that it can make a reciprocative movement in the horizontal direction along the endless belt 38 and during the printing operation, the screen frame 40 is driven at the same speed in the same direction as the material 33 to be printed by a screen driving mechanism described hereinafter and after the printing operation, the screen frame 40 is driven in a direction reverse to the direction of the movement of the material 33.

Above the flat screen 41 there is disposed a squeegee member 42 supported on a squeegee supporting mechanism 43 to squeeze out a printing paste or ink (not shown) onto the material 33 to be printed. This squeegee supporting mechanism 43 is supported on a guide rail (not shown) formed on the machine frame so that it can make a reciprocative movement in the horizontal direction along the endless belt 38. During the printing operation, the squeegee supporting mechanism 43 causes the squeegee member 42 to make a scanning movement from one end of the flat screen 41 to the other end of the flat screen 41, whereby printing of the material 33 can be accomplished. A doctor blade 44 is mounted on the squeegee supporting mechanism 43 to return the printing paste or ink to the printing-starting end of the screen after the printing operation.

In order to contact the material 33 on the endless belt 38 with the flat screen 41 at the printing operation and release this contact during the non-printing period, the flat screen 41 and a part of the supporting and transporting mechanism, for example, the receiving roller 37, are arranged so that they can make relative vertical movements. In the embodiment shown in FIGS. 4-A and 4-B, a pair of the squeegee member 42 and the corresponding receiving roller 37 with the endless belt 38 interposed therebetween are arranged so that they can make a reciprocative movement in the horizontal direction, and during the printing operation, the receiving roller 37 is located at an elevated position to contact the material 33 with the printing screen and during the non-printing period, the receiving roller 37 is located at a lowered position to release the contact between the material 33 and the printing screen. The lifting member 20 is disposed horizontally to support the receiving roller 37 when reciprocating in a horizontal direction and also functions to move the receiving roller 37 up or down in a vertical direction. The position of the lifting member 20 is set and controlled by the lifting device detailed hereinbefore, and the receiving roller 37 is moved vertically with the vertical movement of this lifting member 20.

By reciprocating the flat screen 41 on one horizontal plane, scanning a pair of the squeegee member 42 and receiving roller 37 on the flat screen 41 and moving up and down the receiving roller 37 in the vertical direction as illustrated in FIGS. 4-A and 4-B precisely according to the above-mentioned program, the material 33 to be printed can be registered exactly with the flat screen 41, and a deviation of a pattern at every repeat can be remarkably reduced. In the conventional printing method using a flat screen, when the screen contacted with the material to be printed throughout the surface thereof is separated from the material at the completion of the printing operation, there is caused an undesirable phenomenon of scattering of a printing paste or ink from the printing screen. In the embodiment shown in FIGS. 4-A and 4-B, the part of the screen to be contacted with the material 33 is restricted to the region gripped between the squeegee member and the receiving roller, and even when the screen is separated from the material 33' at a high speed at the completion of the printing operation, scattering of the printing paste or ink can be effectively prevented.

As the common drive source for driving the endless belt 38, the flat screen 41 and the squeegee supporting mechanism 43 and moving vertically the receiving roller 37, there is disposed a driving motor 45 on one end portion of the machine frame 34.

An endless belt driving device 46 for driving continuously an endless belt driving roller 35 at a constant speed is disposed, and the driving power of the driving motor 45 is transmitted to a main shaft 48 through a V-belt 47 and then transmitted to the endless belt driving device 46 through a belt-driving connecting shaft 49 and a belt-driving input shaft 50. The main shaft 48 is connected to the driving motor 45 through an electromagnetic clutch 51.

A screen driving device 52 is disposed to reciprocate the screen frame 40 in the horizontal direction. In this screen driving device 52, by a combined operation of a partially toothed wheel and a cam, for example, the continuous one-way rotation of the main shaft 48 is converted to alternating normal and reverse rotations of a screen driving shaft 53 and then converted to the horizontal reciprocative movement of a screen-driving connecting rod 54 extending in the moving direction of the screen 41, namely along the endless belt, by a combination of a pinion and a rack. This screen-driving connecting rod 59 includes a plurality of screen frames 40 fixed thereto at prescribed intervals, and these screen frames 40 are reciprocated in the horizontal direction with the reciprocative movement of the connecting rod 54.

A squeegee driving device 55 is disposed to reciprocate the squeegee supporting mechanism 43 in the horizontal direction. Also in this squeegee driving device 55, the continuous one-way rotation of the main shaft 48 is converted to alternating normal and reverse rotations of a squeegee driving output shaft 56 by a combined operation of a partially toothed wheel and a cam, for example, and the alternating normal and reverse rotations of the shaft 56 are transmitted to a squeegee driving sprocket 60 through a series of power transmitting means such as a squeegee accelerating mechanism 57, a squeegee driving shaft 58 and a miter gear case 59. Idle wheels 61 and 62 are disposed on both the terminal portions of the reciprocative movement passage for the squeegee supporting mechanism 43, and a roller chain 63 is stretched among these idle wheels 61 and 62 and the squeegee driving sprocket 60 and a plurality of squeegee supporting mechanisms 43 are fixed to the roller chain 63 at suitable intervals through a suitable fixing mechanism (not shown). In this arrangement, by the alternating normal and reverse rotations of the squeegee driving sprocket 60, each of the squeegee supporting mechanisms 43 is reciprocated in the horizontal direction.

The printing operation using the printing machine shown in FIGS. 4-A and 4-B will now be described.

The material 33 to be printed is pasted on the surface of the endless belt 38 by the pasting roller 39, and the material 33 is supported and fed continuously at a constant speed in a certain direction (to the left in the drawings) into the printing zones A by the endless belt 38. At the start of the printing operation, the flat screen 41 is moved in the same direction (to the left) as the moving direction of the material 33 at the same speed as the moving speed of the material 33. At this moment, the squeegee member 42 is located at one end of the screen 41 (the left end in the drawings). The receiving roller 37 is lifted up to the uppermost position just after the completion of acceleration of the screen 41 to cause the material 33 on the endless belt 38 to come into contact with the screen 41. In this state, the squeegee member 42 is paired with the receiving roller 37 and they are moved in a direction (to the right in the drawings) reverse to the moving direction of the material 33 to perform printing on the moving material 33 through the screen 41.

Just before the squeegee member 42 arrives at the other end (the right end in the drawings) of the screen 41, the printing operation is completed, and the lifting member 20 is lowered and in turn, the receiving roller 37 is lowered, whereby the contact of the material 33 with the flat screen 41 is released. The advance of the flat screen 41 is stopped and the screen 41 is then moved in a direction (to the right in the drawings) reverse to the moving direction of the material 33. By lifting up the squeegee member 42 held by the squeegee supporting mechanism 43 from the operating position and bringing down the doctor blade 44 attached to the squeegee supporting mechanism 43 to the operating position, the squeegee member 42 is exchanged with the doctor blade 44 and the squeegee supporting mechanism 43 is moved in the same direction as the moving direction of the material 33, whereby the ink or paste of the screen 41 is returned to the printing-starting end. With this movement of the squeegee supporting mechanism 43, the receiving roller 37 is moved in the same direction as the moving direction of the material 33 at the lowered position thereof.

When the squeegee supporting mechanism 43 arrives at one end (the left end in the drawings) of the screen, the return course movements of the flat screen 41 and the pair of the squeegee member and the receiving roller are stopped. In this state, the doctor blade 44 is exchanged with the squeegee member 42 and the receiving roller 37 is lifted up, and the printing course movement of the screen 41 and squeegee member 42 is started. Thus, the foregoing operations are continuously repeated. In this automatic screen printing method, during a period from the start of the printing operation to the start of the printing operation of the next cycle, the material 33 to be printed is moved by a distance corresponding to the length of one repeat, and the material 33 can be printed in a continuous manner.

When the lifting device of the present invention, detailed hereinbefore, is employed in an automatic screen printing machine, operations of the vertically moving members of the printing machine can be performed precisely and assuredly according to a strictly controlled program, and stopping times necessary for the printing operation or the like can be sufficiently maintained and vertical movements can be accomplished at good timings accordantly with other operations in the printing machine. These are prominent advantages attained according to the present invention.

What I claim is:

1. An automatic screen printing machine comprising a transporting mechanism for supporting thereon a material to be printed and transporting it continuously or intermittently to a printing operation zone, a flat screen disposed in the printing operation zone above a running passage for the material to be printed, a squeegee member disposed above said screen to squeeze out a printing paste or ink onto the material to be printed through said screen, and a lifting device disposed in said operating zone for causing the material to be printed to come into contact with the screen during a printing step and of separating the material from the screen during a non-printing period by moving vertically at least one of said transporting mechanism and said squeegee member and screen relative to each other by means of a lifting member; said lifting device comprising a lifting cam mechanism and a gear mechanism for driving intermittently said lifting cam mechanism and restraining intermittently said lifting cam mechanism, said gear mechanism comprising a first partially toothed wheel including a toothed large diameter circumferential portion and a non-toothed small diameter circumferential portion, said partially toothed wheel being continuously driven and rotated by driving means connected therewith and a second partially toothed wheel including at least one toothed circumferential portion and at least one projected portion having a concave face capable of engaging the non-toothed smooth circumferential portion of the first partially toothed wheel, said first and second partially toothed wheels disposed adjacent to and in operable contact with each other such that the first and second partially toothed wheels are intermittently engaged with each other and are intermittently restrained by each other whereby engagement of the teeth of said first partially toothed wheel with the teeth of said second partially toothed wheel, drives and causes the second partially toothed wheel to rotate, and engagement of the projected portion of said second partially toothed wheel with the non-toothed smooth circumferential portion of said first partially toothed wheel, restrains the rotation of the second partially toothed wheel; said lifting cam mechanism including a cam and said second partially toothed wheel wherein said cam is fixed to said second partially toothed wheel to rotate together and said cam mechanism is operably connected to said lifting member whereby the rotation of said second partially toothed wheel and said cam causes the lifting member to be lifted or lowered and to be held at an elevated position or a lowered position by restraint of the rotation of said second partially toothed wheel.

2. The automatic screen printing machine of claim 1 wherein in the first partially toothed wheel, in a boundary between the toothed large diameter circumferential portion and the non-toothed smooth small diameter circumferential portion of the wheel, there is formed a stepped shoulder capable engaging the projected portion of said second partially toothed wheel and there is formed on the base portion of said stepped shoulder a notch allowing the rotation of the projected portion of the second partially toothed wheel.

3. The automatic screen printing machine of claim 1 including a cam groove and a cam follower connected to said lifting member, said cam groove being integral with said cam and operably connected to said second partially toothed wheel and being capable of displacing said cam follower between the elevated position and the lowered position, and said second partially toothed wheel includes two projected portions, the first of which restrains rotation so that said cam follower is held at a lowered position and the second of which restrains rotation so that said cam follower is held in an elevated position; the teeth of said second partially toothed wheel being formed on the outer part of the circumference of said wheel between said first projected portion and said second projected portion so as to form two sets of teeth, each of which set has the same number of teeth as the number on the first partially toothed wheel.

4. The automatic screen printing machine of claim 1 wherein said transporting mechanism comprises an endless belt and a receiving roller for supporting said endless belt which are vertically movable in the printing operation zone, and said lifting member comprises a horizontally disposed rail which supports said receiving roller when said receiving roller reciprocates in a horizontal direction.

* * * * *